US006419548B1

(12) United States Patent
Wittes et al.

(10) Patent No.: US 6,419,548 B1
(45) Date of Patent: Jul. 16, 2002

(54) BRA SHIELD, BRASSIERE AND METHOD

(75) Inventors: James M. Wittes, Bernardsville; Anne Zuckerman, Princeton, both of NJ (US)

(73) Assignee: OME LLC, Princeton, NJ (US)

( * ) Notice: Subject to any disclaimer, the term of this patent is extended or adjusted under 35 U.S.C. 154(b) by 0 days.

(21) Appl. No.: 09/670,949

(22) Filed: Sep. 27, 2000

(51) Int. Cl.[7] ..... A41C 3/00
(52) U.S. Cl. ..... 450/57; 450/58; 2/267
(58) Field of Search ..... 450/38, 57, 58, 450/37, 39, 40, 53–56, 64–67; 2/267, 268

(56) References Cited

U.S. PATENT DOCUMENTS

| | | | |
|---|---|---|---|
| 2,570,352 | A | 10/1951 | LaRoe et al. |
| 2,630,119 | A | 3/1953 | Aagessen |
| 3,285,247 | A | 11/1966 | Morin |
| 3,301,254 | A | 1/1967 | Schickedanz |
| 3,840,012 | A | 10/1974 | Rushton, Jr. |
| D246,729 | S | 12/1977 | Murphy |
| 4,270,538 | A | 6/1981 | Murphy |
| 4,674,131 | A | 6/1987 | Broel |
| 5,017,174 | A | 5/1991 | Gowrylow |
| 5,032,103 | A | 7/1991 | Larsson |
| D321,273 | S | 11/1991 | Hull |
| 5,326,305 | A | 7/1994 | Fochler |
| 5,683,286 | A | 11/1997 | Kielland |
| 5,690,536 | A | 11/1997 | Madden et al. |

OTHER PUBLICATIONS

Freedom Form—Wancio & Company—Lutz, Florida—packaging and informative insert.
Fashion Forms (Breast Petals)—packaging and informat-inve insert.

*Primary Examiner*—Gloria M. Hale
(74) *Attorney, Agent, or Firm*—Kramer Levin Naftalis & Frankel LLP; Gregor N. Neff

(57) ABSTRACT

The breast shield is concave in shape, preferably molded of a soft flexible material with a central opaque portion and edges which can easily expand and contract to facilitate conforming the shield to the breast of the wearer. The central portion of the shield is opaque and relatively thicker than the outer periphery of the shield . It covers the nipple and the aureola of the breast to prevent it from being seen through the sheer material of brassieres and outer clothing. Preferably, the shield has generally radially-extending gaps in the outer periphery so as to make the shield conform easily to the shape of the wearer, and to be less visible and more comfortable to the wearer. A centrally located pad is provided, in one embodiment, to enhance the comfort of the wearer. A pair of the shields are fitting into a bra and worn by a person for modesty purposes. A kit is provided which includes a plurality of shields and replacement pads and/or adhesive to use the shields without a bra.

18 Claims, 2 Drawing Sheets

FIG.1
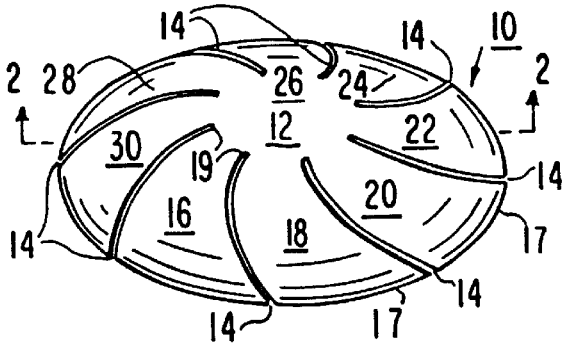
FIG.2
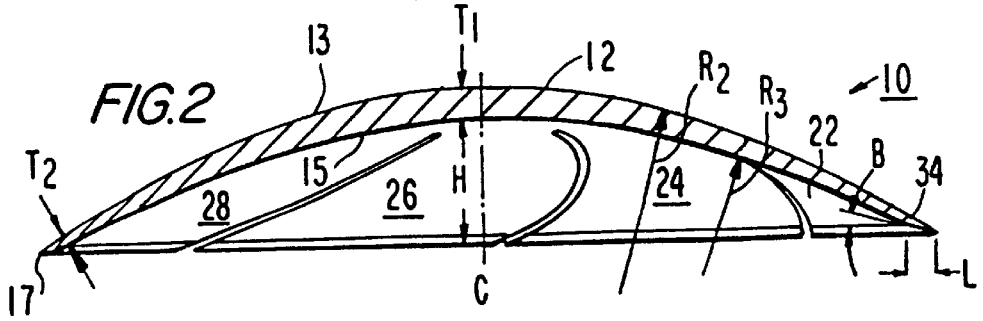
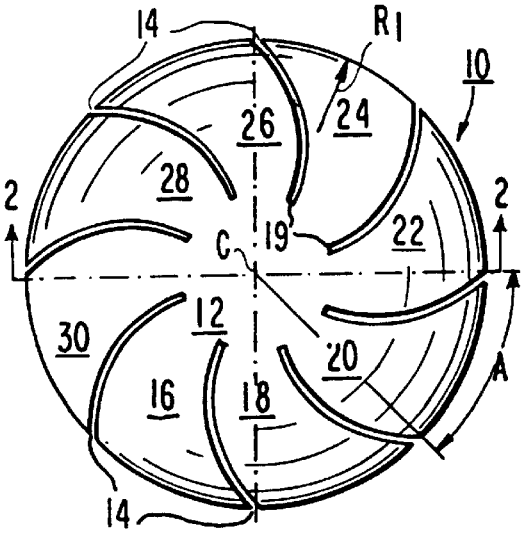
FIG.3
FIG.4
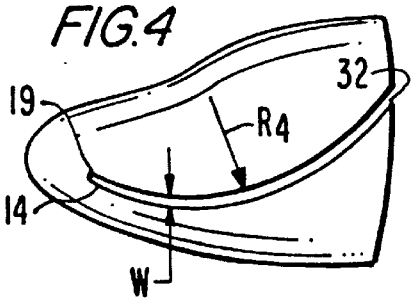
FIG.5
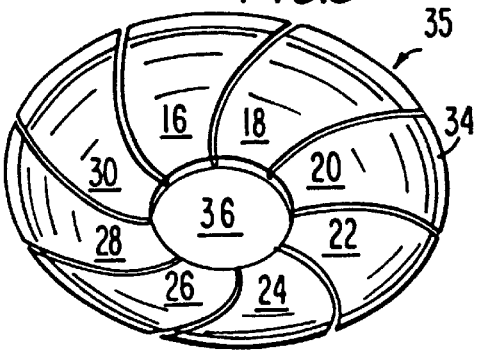
FIG.6
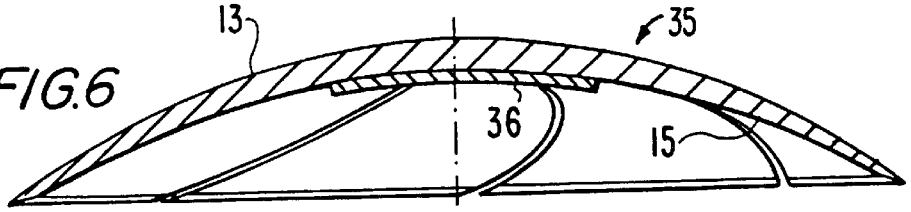

10
42
44
46
42

70
79
78
76
74
10
72
72

50
40
10
38
62
54
58
50
48
44
56
52
46
8
8
60
42
10
50

13
39
37
36

BRA SHIELD, BRASSIERE AND METHOD

The present invention relates to breast shields, brassieres using them, and methods for using same.

Brassieres giving the breast a "natural" look are widely popular today, and have been popular with many people over the years. Such bras often are made of sheer, or even diaphanous material which sometimes can be seen through.

A problem with such bras is that often they provide excessive exposure of the shape of the breasts to others than is desired by the wearer. For example, sometimes an outline of the nipples and other parts of the breast are visible due to the characteristics of the material of the brassiere. This is considered inappropriate in many circumstances, such as in the workplace, professional and business meetings, and in many social circumstances.

Accordingly, it is one of the objects of the invention to provide a modesty shield which prevents the nipples and other parts of the breast from being visible to others, while permitting the wearing of bras made of sheer materials.

Such modesty is provided by padded brassieres. However, many people do not wish to wear padded brasseries, either because their breasts have overly ample proportions to start with, or due to other considerations. One such consideration is that padded brassieres, including those with exceptionally thick front wall portions, are often lumpy in appearance and detract from the desired smooth appearance.

Some breast covering devices are available. They adhere to the breast by means of adhesive. Some form entire cups which are attached by means of adhesive, and some take the form of relatively smaller patches which merely cover the outer end of the breast.

Although such devices can provide modesty coverage for the wearer, the requirement of the use of relatively large areas of adhesive to attach the devices is very undesirable. Special precautions are recommended by the manufacturers, such as using a special skin-preparation lotion before applying the adhesive coverings, wearing them only a very limited amount of time before removing them, and taking special precautions to remove the coverings carefully and by prelubrication with baby oil, for example, so as not to provide excessive damage to the skin. Nonetheless, the skin can be irritated and made to become very sore by the use of such devices.

Another disadvantage of such adhesive covers is that they can be used only once and then must be thrown away. This adds expense and waste.

Other modesty covers are known which comprise soft, circular cloth or felt inserts for bras. Such inserts have an extra circular layer of cloth or felt in the center to thicken the cover in the center. There also is a hole in the center of the extra layer to receive the nipple. Such inserts do not readily adapt to the specific contour of the breast of the wearer, and may give a lumpy appearance. Moreover, they can be relatively expensive to make.

Accordingly, it is another object of the invention to provide a breast shield and bra using such a shield and a method of providing modesty protection for the wearer in which the foregoing disadvantages are alleviated or eliminated.

In particular, it is an object of the invention to provide a breast shield which is very adaptable to the specific contour of the breast of the wearer, and provides a smooth, rounded outward appearance when in use.

It is a further object of the invention to provide such a shield which is comfortable to wear and is difficult or impossible for others to see.

It is yet another object of the invention to provide such a shield, brassiere and method using same which are relatively inexpensive to make and easy to use to provide the desired modesty.

It is a further object of the invention to provide such a shield which is washable and re-usable and needs no adhesive, when used with a bra or similar garment.

In accordance with the present invention, the foregoing objects are met by the provision of a breast shield which is concave in shape and has a readily enlargable and contractible outer periphery and an opaque central region so as to cover the nipple and at least part of the aureola of the breast, while readily conforming to the shape of the individual wearer's breast.

It is a further feature of the invention that the expandability and contractability of the outer periphery is provided by gaps which extend at least partially radially and form the outer periphery into flexible flaps or "petals".

It is a further feature of the shield that the central portion of the shield is relatively thicker than the outer periphery so as to minimize the visibility of the shield.

It also is a feature of the invention that the gaps are curved in shape to cause at least a portion of each gap to extend transversely across the major stress lines of the bra to further minimize visibility of the shield when in use.

In another embodiment of the invention, a soft fabric pad is located at the center of the inner wall of the shield. Preferably, the pad can be snapped into place and removed easily so that the pads can be replaced more often than the shields.

The combination of bra with a pair of shields inserted therein and worn by a person is a specific preferred embodiment of the invention.

The invention also provides a method for the wearer to assure modesty and a rounded, smooth outer appearance to the bustline by use of the shield and brassiere combination of the present invention.

If necessary or desired, a small amount of adhesive can be applied to the shield selectively by the wearer when it is desired to use the shield without a bra or similar support.

A kit is provided including one or more shields and an adhesive. The adhesive can be washed off of the shield and easily can be washed off of the skin of the wearer.

A different kit also is provided. This kit has several shields and replacement pads, with or without adhesive.

The foregoing and other objects and advantages and features of the present invention will be set forth in or will be apparent from the following description and drawings.

IN THE DRAWINGS

FIG. 1 is a top perspective view of a breast shield constructed in accordance with the present invention;

FIG. 2 is an enlarged cross-sectional view taken along line 2—2 of FIGS. 1 and 3;

FIG. 3 is a top plan view of the breast shield shown in FIGS. 1 and 2;

FIG. 4 is an enlarged view of a portion of the breast shield shown in FIGS. 1–3;

FIG. 5 is a bottom perspective view of another embodiment of the breast shield of the present invention;

FIG. 6 is a cross-sectional view, similar to that of FIG. 2, of the shield shown in FIG. 5;

SHIELD

Figures 7, 8, 9, 10:
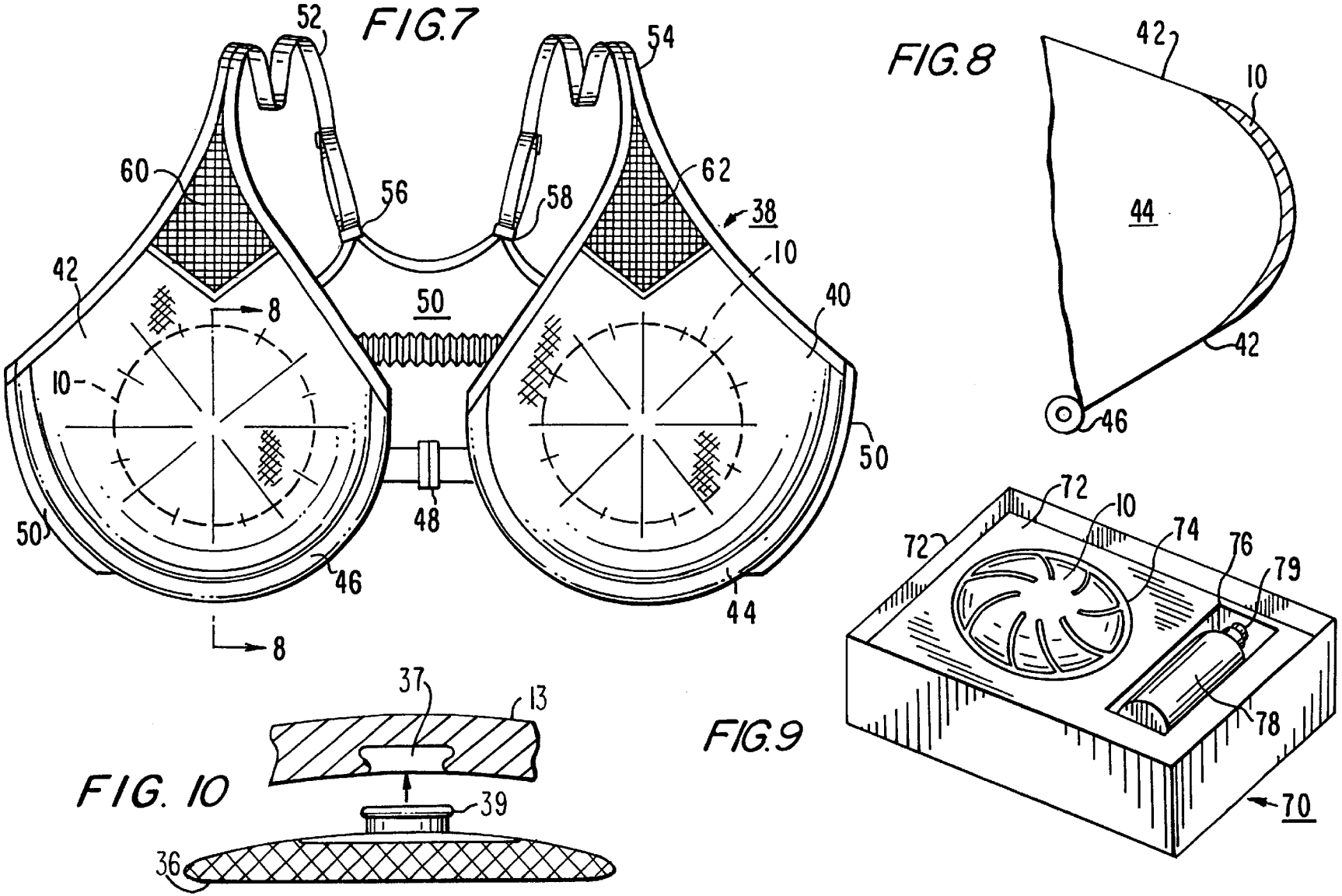
FIG. 7 is an elevation view of a brassiere into which two of the breast shields have been inserted.
FIG. 8 is a cross-sectional view taken along line 8—8 of FIG. 7.
FIG. 9 is a perspective view of a kit constructed in accordance with the present invention.
FIG. 10 is an enlarged exploded view of a portion of the structure shown in FIG. 6.

FIGS. 1 through 4 show a breast shield 10 constructed in accordance with the present invention. The shield 10 is circular and is molded to have a concave inner surface 15 and a convex outer surface 13 (see FIG.2).

The shield 10 has a central solid portion 12 and a plurality of relatively thin gaps 14 extending outwardly towards the outermost rim 17 of the shield.

The innermost ends 19 of the gaps 14 are generally directed towards the center "C" (FIG. 3) of the shield. Each of the gaps 14 is curved, and preferably is shaped like the arc of a circle. As it is shown in FIG. 3, the gaps extend in a counterclockwise direction at progressively greater distances from the center "C".

The gaps 14, in essence, divide the outer peripheral portion of the shield into a set of curved petals 16, 18, 20, 22, 24, 26, 28 and 30. Each of these petals is very flexible and can flex independently of the others.

As it is shown in FIG. 2, the shield 10 is substantially thicker in the central portion 12 than at the edge. Furthermore, the outer edge is beveled as shown at 34 in FIG. 2. This makes the outer edge of the shield relatively thin so that it does not form a high ridge and is relatively invisible when worn in a bra or similar support garment.

The shield 10 is made of a relatively soft rubber or rubber substitute so that the outer flaps or petals of the shield 16, 18, 20, 22, 24, 26, 28 and 30 are soft and flexible and conform to the shape of the individual wearer's breast.

Although the gaps 14 could be straight-line radial gaps, the curved shape is preferred because it is believed that the directions of stress of the material of a bra are generally radial, towards the center of each bra cup. It is believed that, by making the gaps 14 curved rather than straight, they are mostly transverse to the bra stress lines, and that the bra materials does not easily enter any of the gaps. This helps maintain a smooth outward appearance for the bra and the outer clothing of the wearer.

MATERIALS AND DIMENSIONS

Although many different materials can be used to form the breast shield 10, it is preferred that the material be a relatively soft rubber or foam-rubber, such as silicone rubber, or a foam-rubber substitute such as a styrene based thermoplastic elastomer, which is molded to the shape shown in the drawings.

The curvature of the concave shape of the shield 10 and the diameter of the shield are selected so as to fit as many different breast sizes and shapes as possible, while providing the rounded appearance desired.

In a breast shield which has been made and successfully tested in accordance with the present invention, a styrene based thermoplastic elastomer was injection molded to form the shape shown in FIGS. 1 through 4. The material, when molded, had a hardness of 35 to 45 durometer on the Shore A scale. A material sold by Advanced Elastomer Systems under the brand name "Santoprene" is one such material.

Preferably, a medical grade of such materials is used to give maximum assurance that there will be little or no effect on the wearer's body by contact with the shield.

The outer diameter of the shield is approximately two and three-quarter inches. That is, the radius R1 shown in FIG. 3 is approximately 1.4 inches.

The radii R2 and R3 shown in FIG. 2 are, respectively, 2.3 and 2.8 inches. The centers for the radii R2 and R3 are vertically offset from one another so as to give the shape shown in FIG. 2.

The thickness of T1 of the material in the center 12 of the shield is approximately 0.09 inch, and the thickness T2 near the outer edge 17 of the shield is approximately one-quarter of $T_1$—that is, 0.02 inch. The length "L" of the beveled portion 34 is approximately 0.079 inches, and the angle "B" of the beveled portion 34 is 15°. The height "H" from the bottom edge to the top of the inner wall 15 in the central portion 12 of the shield is 0.37 inches.

As it is shown in FIG. 3, the outer end 32 of each gap 14 is located approximately 45° away from the outer end of the next gap. That is, the angle "A" in FIG. 3 is 45°.

Referring now to FIG. 4, the radius R4 of the arc forming each gap 14 is three-quarters of an inch. That is, 0.75 inch. The width "W" of each gap is approximately 0.030 inch.

Of course, the foregoing dimensions are given merely by way of example in describing a specific embodiment of the invention. Other dimensions can be used to practice the invention without deviation from its basic principles. As an option, the entire concave surface or the central portion could be "flocked" with cloth fibers.

An alternative embodiment of the invention is shown in FIGS. 5 and 6. The shield 35 shown in these figures is the same as that shown in FIG. 1 except that a circular pad 36 is attached to the center section 12 of the shield for greater comfort and moisture absorption. The diameter of the pad 36 can be varied, as desired. It can be less than the diameter of the center portion 12 of the shield, that is, around 0.9 inches, or it can extend out past the inner ends 19 of the gaps 14, to a diameter of say 1 to 2.7 inches.

Preferably, the pad is made of a soft foam, even softer than the material used to form the body of the shield, and covered with a cloth cover.

If desired, the pad 36 can be adhered to the shield body during the molding process, by the use of well-known techniques.

The preferred attachment means, shown in FIGS. 6 and 10, comprises a "snap" fastener including a socket 37 in the inner surface 15 of the shield, and a molded plastic button 39 (FIG. 10) which is bonded to the pad 36 and snaps into the socket 37 when pressed. The pad 36 can be made of laminated foam layers or solid foam covered with a cloth outer cover. That is, the pad 36 is constructed like a pillow, but is made of absorptive materials.

It is desired that the shield 10 or 36 be washable repeatedly without material deterioration. Therefore, the material of which the shield is molded, and the materials of the pad 36, if it is used, should be made to withstand several washings.

Alternatively, the pads 36 can be removed after one or a few uses, discarded and replaced with new pads.

BRASSIERE WITH SHIELDS

FIG. 7 shows a brassiere 38 with two of the shields 10 in place within the cups 40 and 42 of the bra.

Although virtually any bra can be used with the shields of the present invention, the particular bra shown is one in which the bra cups 40 and 42 are made of relatively sheer, flexible and revealing material so as to give a so-called "natural" look.

The radial lines on the bra cups 40 and 42 generally indicate the direction of the stresses which are believed to be applied to the bra cup material.

The bra 38 has wired rims 44 and 46 on the lower edges of the cups, and has a front clasp 48 to hold the cups together. An elastic backband 50 extends around the back of the wearer and is attached to the sides of the bra. Shoulder straps 52 and 54 are connected to the backband 50 at 56 and 58, respectively.

Decorative panels 60 and 62 of a different material having a larger mesh size than the material of the cups 40 and 42 are provided.

FIG. 8 is a cross-sectional view, partially broken away, showing the cup 42 of the bra filled with the breast 44 of a wearer, with a shield 10 in place. It can be seen that the shield 10 creates substantially no bulges. Moreover, the outer surface of the front portion of the bra is rounded and smooth, giving the modest appearance desired.

The shape of the shield 10 or 36 of the present invention is beneficial in holding the shield in place when worn with a brassiere. It is believed that there is little slippage between the outer surface of the shield and the material of the brassiere. Furthermore, once inserted, the shield tends to stay in place on the wearer's breast without any need for adhesive. The shield covers the nipple and at least part of the aureole of the breast. Preferably, the shield is given a skin color so as to further minimize visibility.

KITS

There are times when the wearer does not wish to or cannot wear a bra or similar support garment. The modesty shields of the present invention then can be used with an adhesive to make them adhere to the breast despite the absence of such support.

This often is desired when wearing backless or strapless evening gowns, etc.

FIG. 9 shows a kit which is supplied to the wearer who might wish to wear the shields without a bra. The kit 70 includes a container 72 (whose lid is not shown) with a shaped holder 72 with a cavity 74 holding one or more of the shields 10.

A second cavity 76 holds a tube or bottle 78 of water-soluble adhesive with an applicator tip 79. Such water-soluble adhesives suitable for applying to the skin are readily available.

When the wearer desires to use the shields 10 without a bra, the person then applies adhesive from the tube or bottle 78 through the applicator tip 79 to the inner surfaces of the petals 16, 18, etc., or just selected ones of them, sufficient to adhere the shields to the breast. Then, the garment to be worn is put on over the shields.

After the shields have been removed, the adhesive may be washed off of the body and the shields with ordinary soap and water.

Another kit also is shown in FIG. 9. Instead of, or in addition to the adhesive 78, a plurality of pads 36 are supplied in a cavity 80. Thus, the kit can be a container with shields 10 and replacement pads 36, or shields with adhesive 78, or shields with both adhesive and replacement pads.

If desired, contact adhesive can be applied to the petals 10 of the shields with a release paper covering, instead of the supply of 78 of liquid adhesive.

The above description of the invention is intended to be illustrative and not limiting. Various changes or modifications in the embodiments described may occur to those skilled in the art. These can be made without departing from the spirit or scope of the invention.

What is claimed is:

1. A breast shield comprising a concave shield member made of soft, flexible material, said member having a size and shape to cover the nipple and at least a portion of the aureola of a human breast, said shield member having a central portion and a peripheral portion spaced outwardly from said central portion, at least said central portion of said shield member being opaque, said shield member being easily expandable and contractible in said peripheral portion to conform in shape to the individual breast shape of the wearer, said peripheral portion having a plurality of elongated, relatively thin gaps formaing said peripheral portion into a plurality of closely spaced petals.

2. A breast shield as in claim 1 in which said gaps have opposed, spaced apart edges extend generally in a radial direction, but which are curved in a direction to extend across radial lines.

3. A breast shield as in claim 1 in which said shield is molded, and has a single wall, the thickness of said wall being substantially greater in said central portion than in said peripheral portion.

4. A breast shield as in claim 1 in which said shield member has an inner wall and a soft pad mounted to said inner wall in said central portion.

5. A breast shield comprising a concave shield member made of soft, flexible material, said member having a size and shape to cover the nipple and at least a portion of the aureola of a human breast, said shield member having a central portion and a peripheral portion spaced outwardly from said central portion, at least said central portion of said shield member being opaque, said shield member being easily expandable and contractible in said peripheral portion to conform in shape to the individual breast shape of the wearer, in which said shield member has an inner wall and a soft pad mounted to said inner wall in said central portion, and including a snap fastener structure for securing said pad to said inner wall of said shield.

6. A breast shield comprising a concave shield member made of soft, flexible material, said shield member comprising a wall which is relatively thin, said member having a size and shape to cover the nipple and at least a portion of the aureola of a human breast, said shield member having a central portion and a peripheral portion spaced outwardly from said central portion, at least said central portion of said shield member being opaque, the thickness of said wall being tapered , with said wall in said central portion being substantially thicker than said wall in said peripheral portion.

7. A breast shield as in claim 6 in which said peripheral portion is expandable and contractible to conform to the shape of the breast of the person wearing said shield, and in which said peripheral portion has a plurality of elongated, relatively thin gaps forming said peripheral portion into a plurality of closely-spaced petals.

8. A breast shield as in claim 7 in which said wall has an inner surface, and a pad made of soft, flexible material secured to said inner surface and covering said central portion of said shield.

9. A brassiere having a pair of cups, each with a shield in it, said shield comprising a concave shield member made of soft, flexible material, said member having a size and shape to cover the nipple and at least a portion of the aureola of a human breast, said shield member having a central portion and a peripheral portion spaced outwardly from said central portions, at least said central portion of said shield member being opaque, said shield member being easily expandable and contractible in said peripheral portion to conform in shape to the individual breast shape of the wearer, and said peripheral portion having a plurality of elongated, relatively thin gaps forming said peripheral portion into a plurality of closely spaced generally radially-extending petals.

10. A brassiere as in claim 9 in which said shield is molded, and has a single wall, the thickness of said wall being substantially greater in said central portion than in said peripheral portion.

11. A brassiere as in claim 10 in which said shield member has an inner wall and a pad made of soft, flexible material secured to said inner wall and covering said central portion.

12. A brassiere having a pair of cups, each with a shield in it, said shield comprising a concave shield member made of soft, flexible material, said member having a size and shape to cover the nipple and at least a portion of the aureola of a human breast, said shield member having a central portion and a peripheral portion spaced outwardly from said central portion, at least said central portion of said shield member being opaque, said shield member being easily expandable and contractible in said peripheral portion to conform in shape to the individual breast shape of the wearer, said peripheral portion having a plurality of elongated, relatively thin gaps forming said peripheral portion into a plurality of closely spaced generally radially-extending petals, in which said shield is molded, and has a single wall, the thickness of said wall being substantially greater in said central portion than in said peripheral portion, in which said shield member has an inner wall and a pad made of soft, flexible material secured to said inner wall and covering said central portion, and including a snap fastener structure holding each of said pads to its shield, said snap fastener structure including a stud on one member for snapping into an elastically deformable receptacle on the other member.

13. A method of suppressing the outward visibility of the nipples of a person, said method comprising:

(a) providing a pair of shields, each of which is soft, flexible and has a rounded, convex outer surface and a concave inner surface, and has a relatively thin wall with an opaque central section and an expandable and contractible peripheral section, so as to adjust to the shape of the wearer's breast, said peripheral section being tapered and thinner than said central section, (b) assembling said shields with an article of clothing to be worn over said person's breasts, and (c) putting said article of clothing on with said shields covering the breasts of said person.

14. A method as in claim 13 in which said article of clothing is a brassiere.

15. A method as in claim 13 in which each of said shields is molded, with the thickness of said wall tapering off at increasing radial distances from said center portion, and having a plurality of relatively thin gaps extending outwardly from said central section.

16. A method as in claim 13 including providing adhesive on at least said peripheral portion of said inner surface and adhering said shields to the breasts of said person with said opaque portion covering the nipples of said breasts.

17. A breast shield kit, said kit comprising, in combination, a container, at least two breast shields in said container, each of said shields comprising a rounded, concave shield member with an expandable and contractible peripheral portion, and a supply of added articles selected from the group consisting of a plurality of pads removably attachable to the insides of said shields; and a container of adhesive for use in adhering said shields to the breasts of a wearer.

18. A kit as in claim 17 in which said adhesive is water-soluble, and each of said pads has a part of a snap fastener to mate with another part on the interior of said shield.

* * * * *